US009528688B2

(12) United States Patent
McConnell

(10) Patent No.: US 9,528,688 B2
(45) Date of Patent: Dec. 27, 2016

(54) RETROFIT FLOODLIGHT SYSTEMS, BRACKETS AND RELATED METHODS

(71) Applicant: Whyle Ian McConnell, Shoreline, WA (US)

(72) Inventor: Whyle Ian McConnell, Shoreline, WA (US)

( * ) Notice: Subject to any disclaimer, the term of this patent is extended or adjusted under 35 U.S.C. 154(b) by 259 days.

(21) Appl. No.: 14/107,962

(22) Filed: Dec. 16, 2013

(65) Prior Publication Data

US 2015/0167900 A1 Jun. 18, 2015

(51) Int. Cl.

| | |
|---|---|
| ***F21V 11/00*** | (2015.01) |
| ***F21V 17/12*** | (2006.01) |
| ***F21S 8/00*** | (2006.01) |

(52) U.S. Cl.

CPC ..... *F21V 17/12* (2013.01); *F21K 9/20* (2016.08); *F21S 8/036* (2013.01); *F21Y 2105/10* (2016.08); *F21Y 2115/10* (2016.08)

(58) Field of Classification Search

CPC ..... F21K 9/17; F21K 9/20; F21V 21/00; F21V 17/12

USPC ..... 362/370, 432

See application file for complete search history.

(56) References Cited

U.S. PATENT DOCUMENTS

2012/0243231 A1* 9/2012 Vadai ..... F21S 2/00 362/249.02

* cited by examiner

*Primary Examiner* — Andrew Coughlin

(74) *Attorney, Agent, or Firm* — Seed IP Law Group LLP

(57) ABSTRACT

Retrofit floodlight systems, brackets and related methods are provided for retrofitting existing floodlight systems having a floodlight enclosure and a superseded light source to include solid-state lighting functionality. An example retrofit floodlight system includes a floodlight enclosure having a base receptacle and a cover coupled to the base receptacle to define an interior cavity and at least one light generation assembly including an array of solid-state lighting elements operable to collectively emit a flood of light from the floodlight enclosure which is mounted within the floodlight enclosure by a retrofit bracket.

12 Claims, 7 Drawing Sheets

RETROFIT FLOODLIGHT SYSTEMS, BRACKETS AND RELATED METHODS

BACKGROUND

Technical Field

This disclosure generally relates to floodlight systems, and more particularly to retrofit floodlight systems, brackets and related methods that provide solid-state lighting functionality in connection with preexisting floodlight enclosures of superseded light sources, such as, for example, metal halide and high pressure sodium light sources.

Description of the Related Art

Floodlight systems are known which utilize various light sources to emit a flood of light from an enclosure to provide suitable lighting for various activities, including, for example, fishing or crabbing activities on the deck of a marine vessel. Example floodlight systems include metal halide (MH) and high pressure sodium (HPS) floodlight systems, such as, for example, the IC Series HPS and MH floodlights available from Phoenix Products Company, Inc. of Milwaukee, Wis., and the F Series HPS and MH floodlights available from Philips Wide-Lite of San Marcos, Tex. Other similar floodlights include those available from Britmar Marine Inc. of British Columbia, Canada; Aqua Signal GmbH of Bremen, Germany; and Cooper Crouse-Hinds Pauluhn of Houston, Tex. These conventional floodlight systems, however, can suffer from a variety of deficiencies, including non-satisfactory durability, longevity, operational efficiency and/or illumination characteristics. Floodlight systems including solid-state lighting elements, such as light emitting diodes (LEDs), can provide lighting systems with enhanced durability, longevity, operational efficiency and/or illumination characteristics. Existing LED floodlight systems, however, can require a large capital investment to replace existing systems, including the floodlight enclosures thereof.

BRIEF SUMMARY

The retrofit floodlight systems, brackets and related methods described herein provide for the efficient retrofitting of existing floodlight systems having a floodlight enclosure and a superseded light source. Accordingly, preexisting floodlight enclosures can be adapted to provide enhanced solid-state lighting functionality without requiring replacement or disposal of such floodlight enclosures. Advantageously, in many instances, preexisting floodlight systems utilizing metal halide, high pressure sodium and other superseded light sources can be converted to include solid-state light sources with minimal effort.

A retrofit floodlight system may be summarized as including a floodlight enclosure for protecting a light source from an external environment and at least one light generation assembly including an array of solid-state lighting elements operable to collectively emit a flood of light from the floodlight enclosure. The floodlight enclosure may include a base receptacle and a cover coupled to the base receptacle to define an interior cavity, and the base receptacle may include a superseded light source mounting arrangement. The retrofit floodlight system may further include a retrofit support bracket having a light generation support platform and a base structure. The retrofit bracket may be fixedly secured to the base receptacle of the floodlight enclosure via the superseded light source mounting arrangement and the at least one light generation assembly may be supported by the light generation support platform of the retrofit bracket within the interior cavity of the floodlight enclosure opposite the cover.

The retrofit floodlight system may further include a solid-state lighting element driver fixedly coupled to the retrofit bracket within the interior cavity of the floodlight enclosure. The solid-state lighting element driver may be fixedly coupled to the retrofit bracket in a space defined between the light generation support platform and a rear wall of the base receptacle of the floodlight enclosure. The base structure of the retrofit bracket may include a second mounting arrangement located remote from the light generation support platform, and the solid-state lighting element driver may be fixedly coupled to the retrofit bracket via the second mounting arrangement.

The base structure and the light generation support platform may be portions of a single-piece of formed sheet material. The base structure of the retrofit bracket may include opposing sidewalls that extend from a periphery of the light generation support platform, and the second mounting arrangement may be provided on one of the opposing sidewalls. The opposing sidewalls may flare outwardly away from the light generation support platform, and the base structure of the retrofit bracket may include mounting flanges at distal ends of the opposing sidewalls that extend parallel to the light generation support platform and include a mounting arrangement that corresponds to the superseded light source mounting arrangement of the base receptacle of the floodlight enclosure. The opposing sidewalls may taper inwardly with increasing distance away from the light generation support platform. The retrofit bracket may include opposing mounting flanges that extend laterally beyond the light generation support platform, and the mounting flanges may include a mounting arrangement that corresponds to the superseded light source mounting arrangement of the base receptacle of the floodlight enclosure. The mounting flanges may be an extension of the light generation support platform. The mounting flanges may be parallel to and offset from the light generation support platform. The base structure of the retrofit bracket may include a floor that is offset and parallel to the light generation support platform, and the second mounting arrangement may be provided on the floor. The base structure of the retrofit bracket may include opposing sidewalls that extend between the floor and the light generation support platform.

The base structure of the retrofit bracket may include an extension having a mounting face that is arranged perpendicular to the light generation support platform and secured to a sidewall of the base receptacle of the floodlight enclosure. The mounting face may include at least one supplemental mounting arrangement, and the extension may be secured to the sidewall of the base receptacle of the floodlight enclosure by the at least one supplemental mounting arrangement. The floor may be supported in a position that is offset from a rear wall of the base receptacle of the floodlight enclosure.

The light generation support platform may include a light generation assembly mounting arrangement and a supplemental light generation assembly mounting arrangement to accommodate a plurality of light generation assemblies. The light generation assembly mounting arrangement and the supplemental light generation mounting arrangement may overlap to alternatively support light generation assemblies having different sizes. The retrofit floodlight system may further include a supplemental light generation assembly that is supported by the light generation support platform of the retrofit bracket adjacent the other light generation assembly.

A retrofit bracket for converting a floodlight system having a superseded light source and a floodlight enclosure to a solid-state lighting system may be summarized as including: a light generation support platform to accommodate and support at least one solid-state light assembly within an interior cavity of the floodlight enclosure, the light generation support platform including a first mounting arrangement for fixing the at least one solid-state lighting assembly to the retrofit bracket; opposing mounting flanges located at lateral ends of the light generation support platform, the mounting flanges including a second mounting arrangement for fixing the retrofit bracket to the floodlight enclosure; and opposing sidewalls extending away from the light generation support platform, at least one of the opposing sidewalls including a third mounting arrangement for fixing a solid-state lighting element driver to the retrofit bracket.

Another retrofit bracket for converting a floodlight system having a superseded light source and a floodlight enclosure to a solid-state lighting system may be summarized as including: a light generation support platform to accommodate and support at least one solid-state light assembly within an interior cavity of the floodlight enclosure, the light generation support platform including a first mounting arrangement for fixing the at least one solid-state lighting assembly to the retrofit bracket; opposing sidewalls extending away from the light generation support platform; and a floor offset from the light generation support platform by the opposing sidewalls, the floor including a second mounting arrangement for fixing the retrofit bracket to the floodlight enclosure and a third mounting arrangement for fixing a solid-state lighting element driver to the retrofit bracket in a space between the floor and the light generation support platform. The retrofit bracket may further include an extension having a mounting face that is arranged perpendicular to the light generation support platform and that includes at least one supplemental mounting arrangement to secure the extension to a sidewall of an alternate floodlight system.

Another retrofit bracket for converting a floodlight system having a superseded light source and a floodlight enclosure to a solid-state lighting system may be summarized as including a light generation support platform to accommodate and support at least one solid-state light assembly within an interior cavity of the floodlight enclosure, the light generation support platform including a first mounting arrangement for fixing the at least one solid-state lighting assembly to the retrofit bracket; opposing sidewalls extending away from the light generation support platform; a floor offset from the light generation support platform by the opposing sidewalls, the floor including a second mounting for fixing a solid-state lighting element driver to the retrofit bracket in a space between the floor and the light generation support platform; and an extension having a mounting face that is arranged perpendicular to the light generation support platform and that includes a third mounting arrangement to secure the extension to a sidewall of the floodlight enclosure.

Yet another retrofit bracket for converting a floodlight system having a superseded light source and a floodlight enclosure to a solid-state lighting system may be summarized as including a light generation support platform to accommodate and support at least one solid-state light assembly within an interior cavity of the floodlight enclosure, the light generation support platform including a first mounting arrangement for fixing the at least one solid-state lighting assembly to the retrofit bracket; opposing sidewalls flaring outwardly with increasing distance away from the light generation support platform, at least one of the opposing sidewalls including a second mounting arrangement for fixing a solid-state lighting element driver to the retrofit bracket; and opposing mounting flanges located at distal ends of the opposing sidewalls that extend parallel to the light generation support platform and include a third mounting arrangement for fixing the retrofit bracket to the floodlight enclosure.

A method of retrofitting a floodlight system having a superseded light source and a floodlight enclosure to a solid-state lighting system may be summarized as including removing the superseded light source from an interior of the floodlight enclosure; and installing at least one solid-state light generation assembly and a corresponding solid-state lighting element driver within the interior of the floodlight enclosure using a retrofit bracket and a preexisting mounting arrangement of the floodlight enclosure, the retrofit bracket supporting the at least one light generation assembly in a position to emit a flood of light from the retrofitted floodlight system and supporting the solid-state lighting element driver outside a path of the flood of light. The method may further include attaching the at least one light generation assembly and corresponding solid-state lighting element driver to a power source through a preexisting conduit of the floodlight enclosure.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures, features and techniques associated with lighting systems and related methods may not be shown or described in detail to avoid unnecessarily obscuring descriptions of the embodiments. For instance, well-known techniques for wiring and supplying power to the floodlight systems described herein are not described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics of the various embodiments may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The retrofit floodlight systems, brackets and related methods described herein provide for the efficient retrofitting of existing floodlight systems having a superseded light source and a floodlight enclosure. Accordingly, preexisting floodlight enclosures can be adapted to provide enhanced solid-state lighting functionality without requiring replacement or disposal of such floodlight enclosures. Advantageously, in many instances, preexisting floodlight systems utilizing metal halide and other superseded light sources can be converted to include solid-state light sources with minimal effort.

Figure 1:
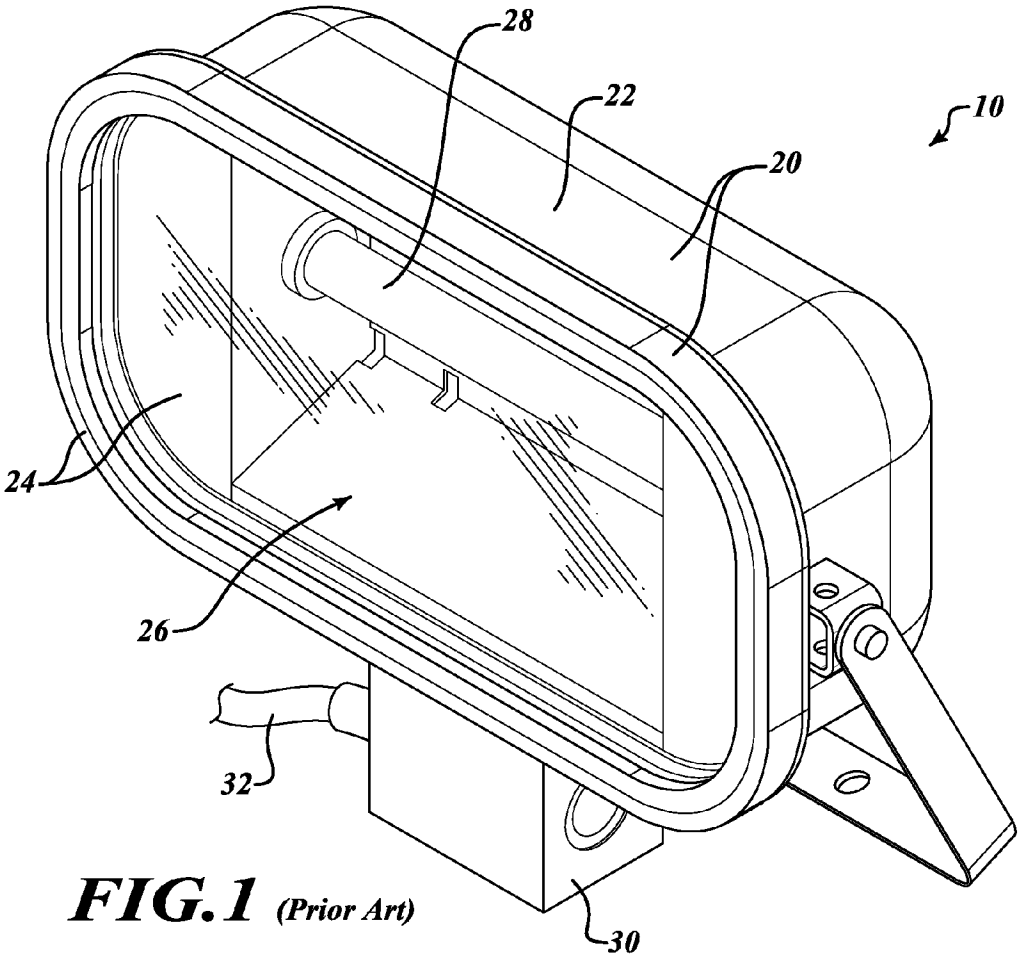
FIG. 1 (Prior Art)
FIG. 1 is an isometric view of a conventional metal halide floodlight system including a floodlight enclosure.

FIG. 1 shows an example of a conventional metal halide floodlight system 10 including a floodlight enclosure 20, which includes a base receptacle 22 and a cover 24 coupled to the base receptacle 22 to define an interior cavity 26. A metal halide light source 28 is provided within the interior cavity 26 to selectively emit a flood of light from the enclosure 20. The enclosure 20 protects the light source 28 from the external environment, which may in some instances, be a harsh environment. A junction box 30 is provided in communication with the interior cavity 26 to enable the supply of electrical power to the metal halide light source 28 via electrical cable 32.

Figure 2:
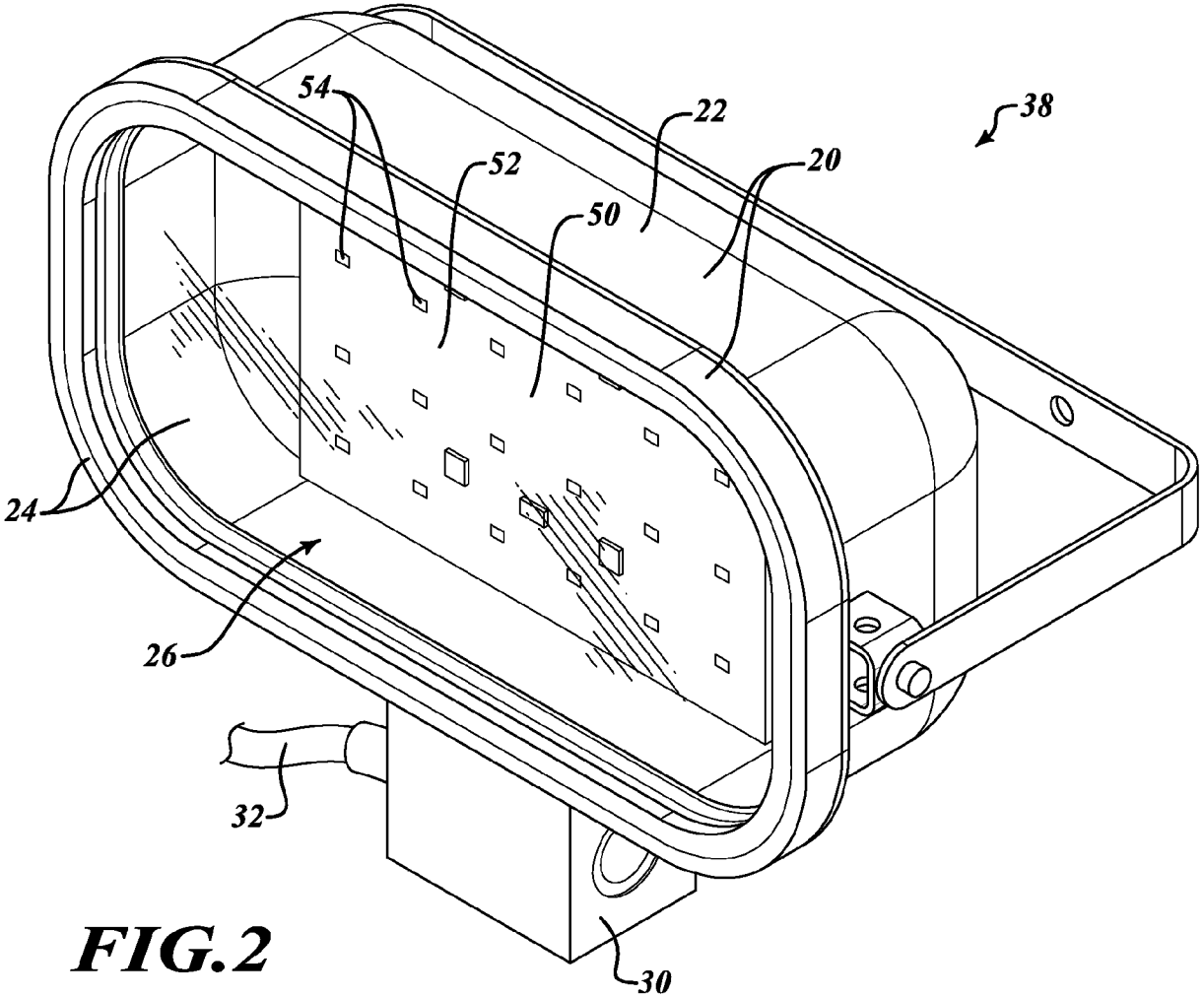
FIG. 2 is an isometric view of a retrofit floodlight system, according to one embodiment, including a solid-state light generation assembly enclosed within the floodlight enclosure of the floodlight system of FIG. 1.
Figure 3:
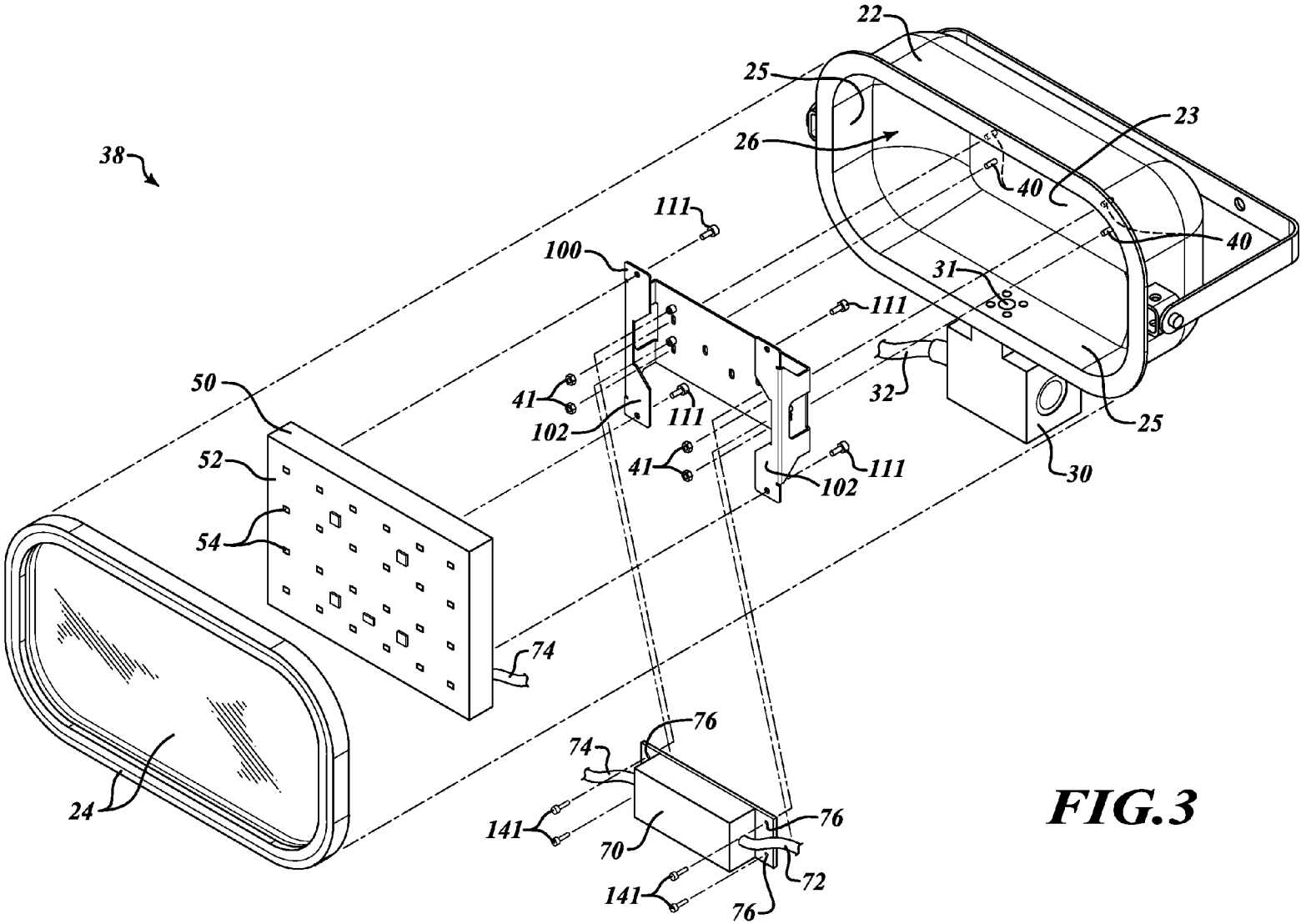
FIG. 3 is an exploded isometric view of the retrofit floodlight system of FIG. 2.
Figure 4:
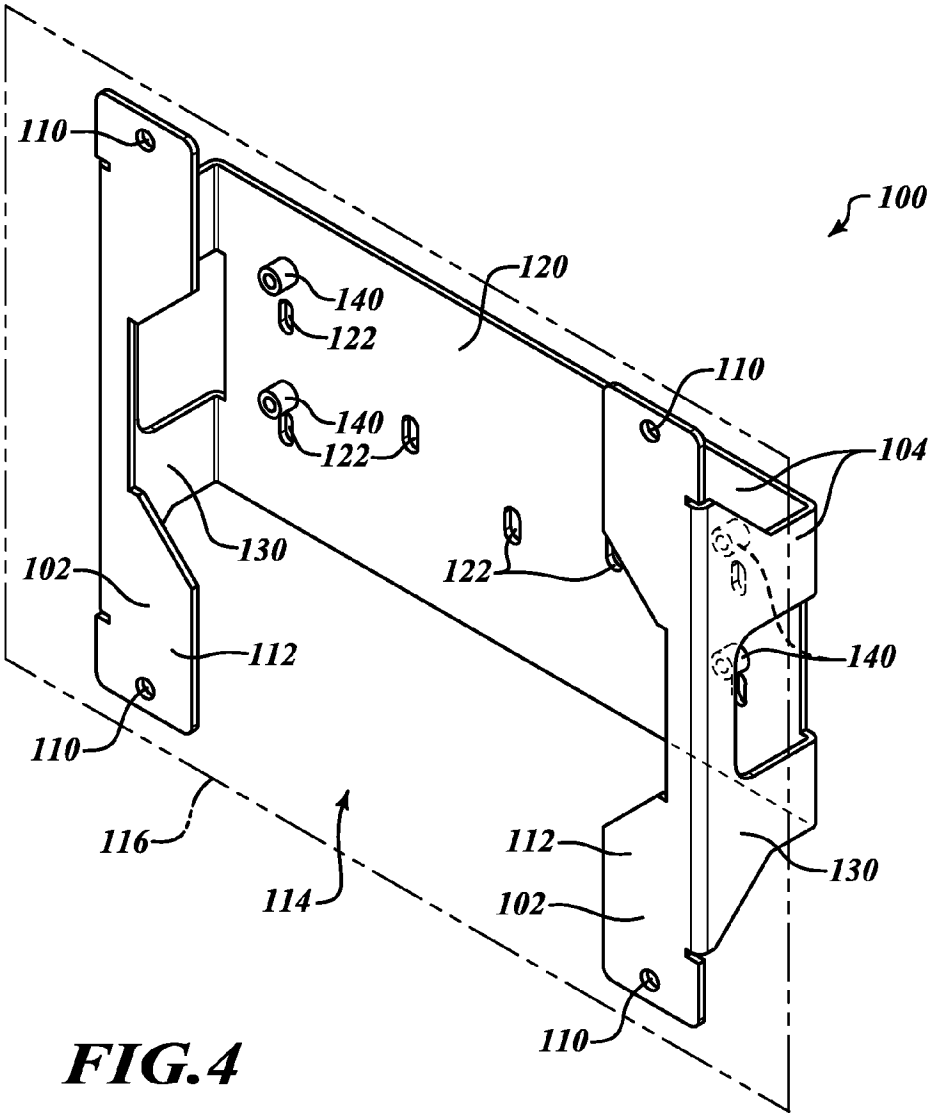
FIG. 4 is an isometric view a retrofit bracket of the floodlight system of FIG. 2.

FIGS. 2 and 3 show an example of a retrofit floodlight system 38, according to one embodiment, in which a light generation assembly 50 including a base 52 and an array of solid-state lighting elements 54 operable to collectively emit a flood of light is installed within an internal cavity 26 of a preexisting floodlight enclosure 20 via a retrofit bracket 100. Details of the retrofit bracket 100 are shown in FIGS. 3 and 4.

With reference to FIGS. 2 and 3, the preexisting floodlight enclosure 20 includes the base receptacle 22 and the cover 24, which is coupled to the base receptacle 22 to define interior cavity 26. A metal halide light source or other superseded light source and possibly surrounding structures, such as, for example, a reflector, are removed from the internal cavity 26 and replaced with the light generation assembly 50. The light generation assembly 50 is supported within the internal cavity 26 by the retrofit bracket 100 opposite the cover 24 of the floodlight enclosure 20 to selectively emit a flood of light therefrom. The light generation assembly 50 may include, for example, the HTS Series 8, 9 and 12 LED lighting products available from Lighting Bare Development, Inc. of Countryside, Ill. The junction box 30 is in communication with the interior cavity 26 to enable the supply of electrical power to the light generation assembly 50 via electrical cable 32.

A solid-state lighting element driver 70 is preferably fixedly coupled to the retrofit bracket 100 within the interior cavity 26 of the floodlight enclosure 20 to regulate or manage the supply of power to the light generation assembly 50. Example drivers include the HLG-150H series driver available from Mean Well USA of Fremont, Calif. and the ANP90 series driver available from Amperor, Inc. of Houston, Tex. The solid-state lighting element driver 70 may receive power via electrical cable 32. The cable 32 may, for example, be coupled to an input cable 72 of the solid-state lighting element driver 70 within junction box 30. An output cable 74 of the driver 70 may be electrically coupled to the solid-state light generation assembly 50 to supply power thereto during operation. In some instances, the solid-state lighting element driver 70 may be fixedly coupled to the retrofit bracket 100 in a space defined between the light generation assembly 50 and a rear wall 23 of the base receptacle 22 of the floodlight enclosure 20. In other instances, the solid-state lighting element driver 70 may be fixedly coupled to the retrofit bracket 100 in a space offset to the side of a projected profile of the light generation assembly 50.

With reference to FIG. 3, the solid-state lighting element driver 70 may include a driver mounting arrangement 76 (e.g., a series of mounting apertures, threaded holes, threaded studs, embedded nuts, etc.) for fixedly coupling the solid-state lighting element driver 70 to the retrofit bracket 100. As an example, the solid-state lighting element driver 70 shown in FIG. 3 includes a series of apertures arranged in a rectangular pattern and which are each sized to receive a corresponding threaded fastener 141 for securing the solid-state lighting element driver 70 to the retrofit bracket 100.

With reference to FIGS. 3 and 4, the retrofit bracket 100 includes a light generation support platform 102 and a base structure 104. The light generation support platform 102 may be a planar portion of the retrofit bracket 100 that provides a platform or stage upon which to mount the light generation assembly 50, as represented by the phantom line labeled 116 in FIG. 4. According to the example embodiment of the retrofit bracket 100 shown in FIGS. 3 and 4, the light generation support platform 102 comprises a pair of flanges 112 arranged at opposing lateral ends of the retrofit bracket 100. A space or gap 114 is provided between the flanges 112 that results in a substantial portion of the underside of the light generation assembly 50 being exposed, which may assist in air circulation and cooling of the light generation assembly 50 during operation. The flanges 112 of the support platform 102 include a light generation assembly mounting arrangement 110 (e.g., a series of mounting apertures, threaded holes, threaded studs, embedded nuts, etc.) for fixedly coupling the light generation assembly 50 to the support platform 102 of the retrofit bracket 100. As an example, the embodiment of the retrofit bracket 100 shown in FIGS. 3 and 4 includes a series of apertures arranged in a rectangular pattern and which are each sized to receive a corresponding threaded fastener 111 to secure the light generation assembly 50 to the support platform 102.

With continued reference to FIGS. 3 and 4, the base structure 104 of the retrofit bracket 100 may include a driver mounting arrangement 140 (e.g., a series of mounting apertures, threaded holes, threaded studs, embedded nuts, etc.)

located remote from the light generation support platform 102 for fixedly coupling the solid-state lighting element driver 70 to the retrofit bracket 100 as discussed above. As an example, the embodiment of the retrofit bracket 100 shown in FIGS. 3 and 4 includes a series of threaded sleeves arranged in a rectangular pattern, which are each sized to receive a corresponding threaded fastener 141 to secure the solid-state lighting element driver 70 to the retrofit bracket 100. As can be appreciated from FIG. 3, the solid-state lighting element driver 70 may be fixedly coupled to the retrofit bracket 100 via the driver mounting arrangement 140 within a space between the support platform 102 and a rear wall 23 of the base receptacle 22 of the floodlight enclosure 20.

With reference to FIG. 3, the base receptacle 22 of the floodlight enclosure 20 may include a superseded light source mounting arrangement 40 that was previously used to mount a superseded light source 28 and/or other surrounding structures (e.g., a reflector). With reference to FIGS. 3 and 4, the retrofit bracket 100 may be fixedly secured to the base receptacle 22 of the floodlight enclosure 20 via the superseded light source mounting arrangement 40 and a corresponding mounting arrangement 122 (e.g., a series of mounting apertures, threaded holes, threaded studs, embedded nuts, etc.) provided at or in the base structure 104 of the retrofit bracket 100. As an example, the embodiment of the retrofit bracket 100 shown in FIGS. 3 and 4 includes a series of slots arranged and sized to receive corresponding threaded studs of the mounting arrangement 40, which together with threaded nuts 41 secure the retrofit bracket 100 to the rear wall 23 of the base receptacle 22 of the floodlight enclosure 20. When the retrofit bracket 100 is fixedly secured to the base receptacle 22 in this manner, the light generation assembly 50 may be supported by the light generation support platform 102 of the retrofit bracket 100 within the interior cavity 26 of the floodlight enclosure 20 opposite the cover 24 to emit light therefrom. In some instances, light generated by the solid-state lighting elements 54 of the light generation assembly 50 may generally or substantially replicate or resemble light previously generated by the superseded light source 28.

With continued reference to FIGS. 3 and 4, the base structure 104 of the retrofit bracket 100 may include a floor 120 and opposing sidewalls 130 that extend between the light generation support platform 102 and the floor 120. The floor 120 may be offset and parallel to the light generation support platform 102. The opposing sidewalls 130 may be perpendicular to the light generation support platform 102 and the floor 120, or may be inclined at an angle relative to the light generation support platform 102 or the floor 120 that is not perpendicular. The opposing sidewalls 130 may be of sufficient length to create a pocket or cavity between the light generation support platform 102 and the floor 120 to house or receive the solid-state lighting element driver 70. The base structure 104, including the floor 120 and the opposing sidewalls 130, and the light generation support platform 102 may be portions of a single-piece of formed sheet material, such as, for example, a sheet of steel or aluminum material formed into the structure shown in FIGS. 3 and 4 by appropriate bending operations. The various mounting arrangements 110, 122, 140 may be formed integrally into the sheet material (e.g., punched, stamped or cut) or otherwise coupled to the sheet material, as in the case of embedded studs or threaded inserts. Some of the mounting arrangements 122 may include elongated slots and/or multiple overlapping arrangements to enable mounting of the retrofit bracket 100 to more than a single preexisting floodlight enclosure 20. Accordingly, the retrofit bracket 100 may be used to retrofit a variety of preexisting floodlight systems 10 from one or more different manufacturers to include solid-state lighting functionality.

Figure 5:
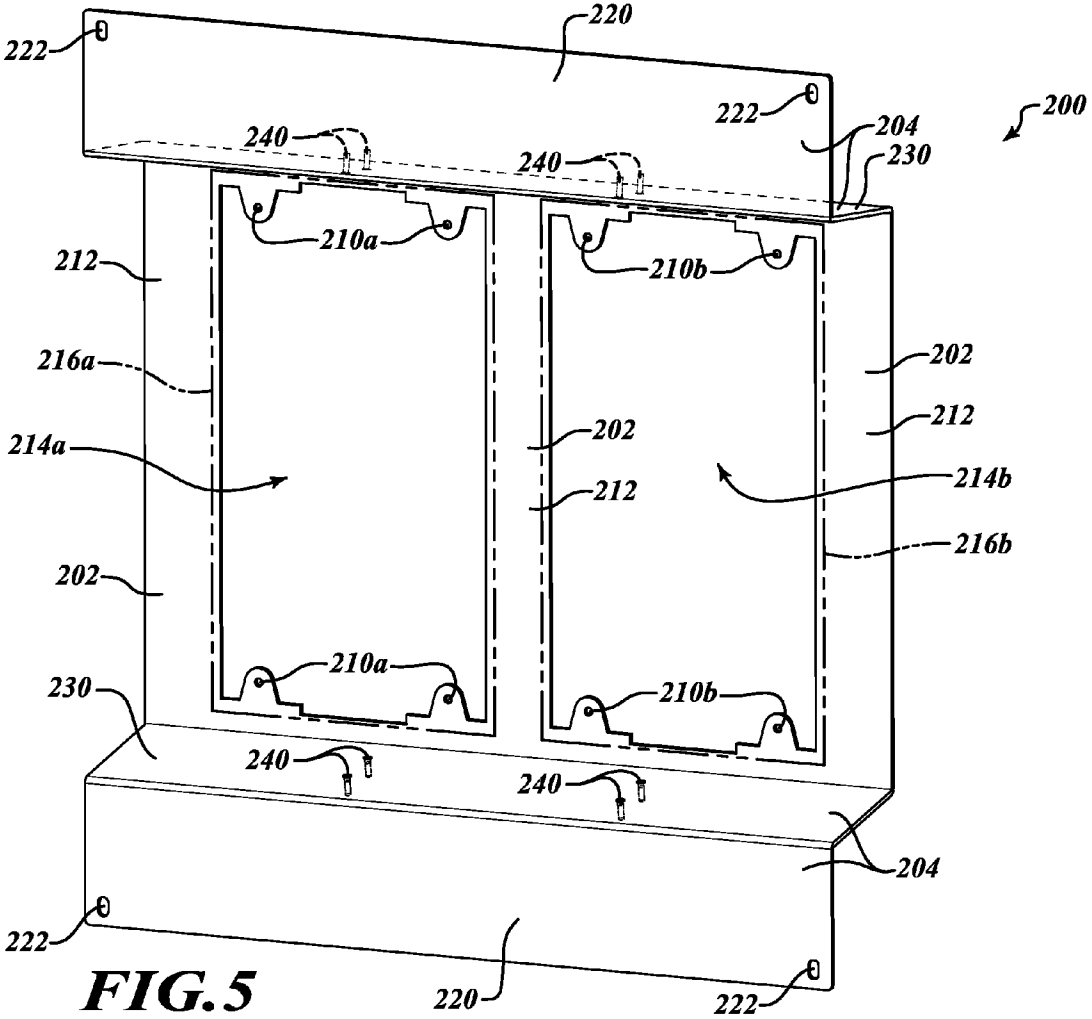
FIG. 5 is an isometric view of a retrofit bracket for converting a floodlight system having a superseded light source and a floodlight enclosure to a solid-state lighting system, according to one embodiment.
Figure 6:
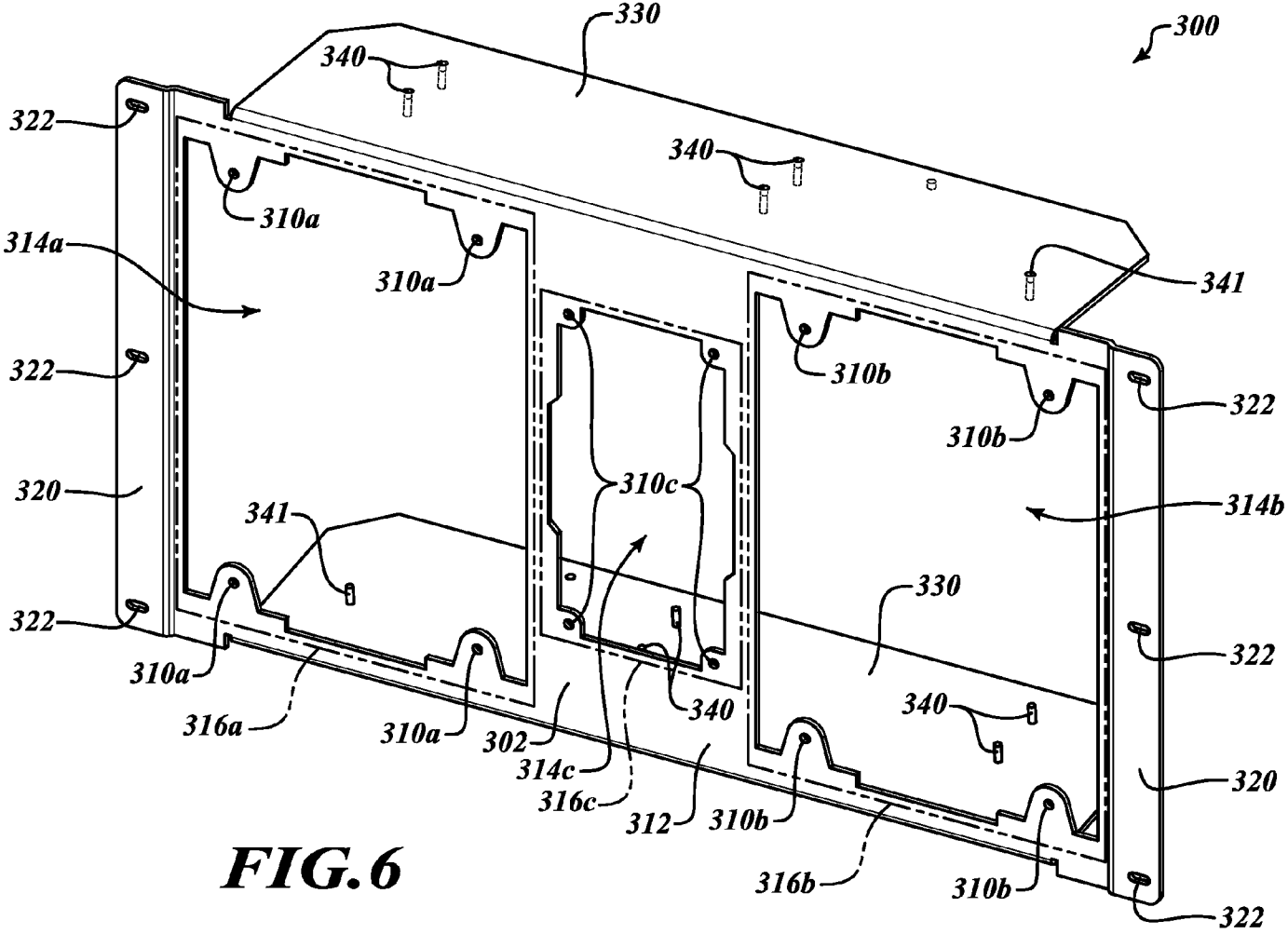
FIG. 6 is an isometric view of a retrofit bracket for converting a floodlight system having a superseded light source and a floodlight enclosure to a solid-state lighting system, according to another embodiment.
Figure 7:
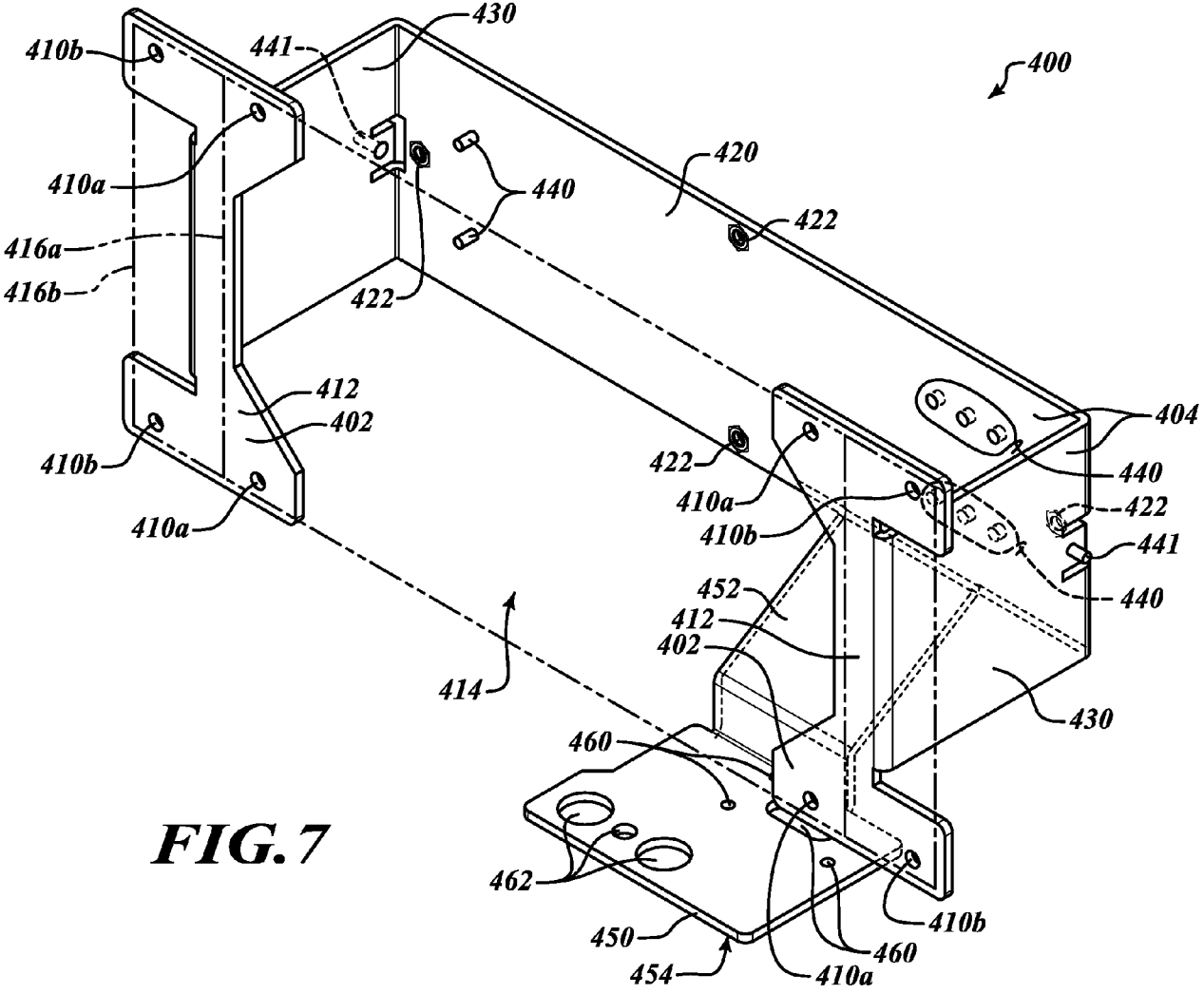
FIG. 7 is an isometric view of a retrofit bracket for converting a floodlight system having a superseded light source and a floodlight enclosure to a solid-state lighting system, according to yet another embodiment.

FIGS. 5 through 7 shown additional example embodiments of retrofit brackets 200, 300, 400.

With reference to FIG. 5, another example embodiment of a retrofit bracket 200 is shown for supporting a pair of adjacent light generation assemblies (not shown) within an internal cavity of a preexisting floodlight enclosure to selectively emit a flood of light therefrom. The light generation assemblies may be, for example, HTS Series 8, 9 and 12 LED lighting products available from Lighting Bare Development, Inc. of Countryside, Ill.

With reference to FIG. 5, the retrofit bracket 200 includes a light generation support platform 202 and a base structure 204. The light generation support platform 202 may be a planar portion of the retrofit bracket 200 that provides a platform or stage upon which to mount the light generation assemblies, as represented by the phantom lines labeled 216*a*, 216*b*. According to the example embodiment of the retrofit bracket 200 shown in FIG. 5, the light generation support platform 202 comprises adjacent frame structures 212 defining clearance apertures 214*a*, 214*b* that leave a substantial portion of the underside of the light generation assemblies exposed, which may assist in air circulation and cooling of the light generation assemblies during operation. The frame structures 212 of the support platform 202 include a respective light generation assembly mounting arrangement 210*a*, 210*b* (e.g., a series of mounting apertures, threaded holes, threaded studs, embedded nuts, etc.) for fixedly coupling the light generation assemblies to the support platform 202. As an example, the embodiment of the retrofit bracket 200 shown in FIG. 5 includes a series or groupings of apertures, each arranged in a rectangular pattern, and wherein each aperture is sized to receive a corresponding threaded fastener to secure the light generation assemblies to the support platform 202.

With continued reference to FIG. 5, the base structure 204 of the retrofit bracket 200 may include a driver mounting arrangement 240 (e.g., a series of mounting apertures, threaded holes, threaded studs, embedded nuts, etc.) located remote from the light generation support platform 202 for fixedly coupling one or more solid-state lighting element drivers (not shown) to the retrofit bracket 200. As an example, the embodiment of the retrofit bracket 200 shown in FIG. 5 includes two separate series of threaded studs arranged in a respective rectangular pattern, which are each sized to receive corresponding threaded nuts (not shown) to secure one or more solid-state lighting element drivers to the retrofit bracket 200. As can be appreciated from FIG. 5, the solid-state lighting element driver or drivers may be fixedly coupled to the retrofit bracket 200 via the driver mounting arrangement 240 within a space to the side of the support platform 202.

With continued reference to FIG. 5, the retrofit bracket 200 may be fixedly secured to a base receptacle of a preexisting floodlight enclosure (not shown) via a superseded light source mounting arrangement thereof and a corresponding mounting arrangement 222 (e.g., a series of mounting apertures, threaded holes, threaded studs, embedded nuts, etc.) provided in or at the base structure 204 of the retrofit bracket 200. When the retrofit bracket 200 is fixedly secured to the preexisting floodlight enclosure in this manner, the light generation assemblies may be supported by the light generation support platform 202 of the retrofit bracket 200 within the interior cavity of the floodlight enclosure opposite a cover thereof to emit light therefrom. In some instances, light generated by the solid-state elements of the light generation assemblies may generally or substantially replicate or resemble light previously generated by the superseded light source.

With continued reference to FIG. 5, the base structure 204 of the retrofit bracket 200 may include opposing sidewalls 230 and mounting flanges 220 at distal ends of the opposing sidewalls 230 that extend parallel to the light generation support platform 202. The opposing sidewalls 230 may flare outwardly away from the light generation support platform 202 and the mounting flanges 220 may include the mounting arrangement 222 that corresponds to the superseded light source mounting arrangement of the floodlight enclosure. In some instances, the mounting arrangement 222 may be arranged at a peripheral edge portion of the retrofit bracket 200 to mount to a corresponding periphery of the preexisting floodlight enclosure.

The opposing sidewalls 230 and the mounting flanges 220 of the retrofit bracket 200 may create a channel within which to receive the light generation assemblies. The opposing sidewalls 230 and the mounting flanges 220 may create opposing pockets or cavities on opposing sides of the light generation support platform 202 to house or receive the solid-state lighting element driver(s). The base structure 204, including the opposing sidewalls 230 and mounting flanges 220, and the light generation support platform 202 may be portions of a single-piece of formed sheet material, such as, for example, a sheet of steel or aluminum material formed into the structure shown in FIG. 5 by appropriate bending operations.

The various mounting arrangements 210*a*, 210*b*, 222, 240 may be formed integrally into the sheet material (e.g., punched, stamped or cut) or otherwise coupled to the sheet material, as in the case of embedded studs or threaded inserts. Some of the mounting arrangements 222 may include elongated slots and/or multiple overlapping arrangements to enable mounting of the retrofit bracket 200 to more than a single preexisting floodlight enclosure. Accordingly, the retrofit bracket 200 may be used to retrofit a variety of preexisting floodlight systems 10 from one or more different manufacturers to include solid-state lighting functionality.

With reference to FIG. 6, another example embodiment of a retrofit bracket 300 is shown for supporting a series of adjacent light generation assemblies (not shown) of different sizes within an internal cavity of a preexisting floodlight enclosure to selectively emit a flood of light therefrom. The light generation assemblies may be, for example, HTS Series 8, 9 and 12 LED lighting products available from Lighting Bare Development, Inc. of Countryside, Ill.

With reference to FIG. 6, the retrofit bracket 300 includes a light generation support platform 302. The light generation support platform 302 may be a planar portion of the retrofit bracket 300 that provides a platform or stage upon which to mount the light generation assemblies, as represented by the phantom lines labeled 316*a-c*. According to the example embodiment of the retrofit bracket 300 shown in FIG. 6, the light generation support platform 302 comprises adjacent frame structures 312 defining clearance apertures 314*a-c* that leave a substantial portion of the underside of each respective light generation assembly exposed, which may assist in air circulation and cooling of the light generation assemblies during operation. The frame structures 312 of the support platform 302 include respective light generation assembly mounting arrangements 310*a-c* (e.g., a series of mounting apertures, threaded holes, threaded studs, embedded nuts, etc.) for fixedly coupling the light generation assemblies to the support platform 302 of the retrofit bracket 300. As an example, the embodiment of the retrofit bracket 300 shown in FIG. 6 includes a series or groupings of apertures, each arranged in a rectangular pattern, and wherein each aperture is sized to receive a corresponding threaded fastener to secure the light generation assemblies to the support platform 302.

With continued reference to FIG. 6, the retrofit bracket 300 may include a driver mounting arrangement 340 (e.g., a series of mounting apertures, threaded holes, threaded studs, embedded nuts, etc.) located remote from the light generation support platform 302 for fixedly coupling one or more solid-state lighting element drivers (not shown) to the retrofit bracket 300. As an example, the embodiment of the retrofit bracket 300 shown in FIG. 6 includes two separate series of threaded studs arranged in a respective rectangular pattern, which are each sized to receive a corresponding threaded nut (not shown) to secure one or more solid-state lighting element drivers to the retrofit bracket 300. As can be appreciated from FIG. 6, the solid-state lighting element driver or drivers may be fixedly coupled to the retrofit bracket 300 via the driver mounting arrangements 340 within a space below the light generation support platform 302.

With continued reference to FIG. 6, the retrofit bracket 300 may be fixedly secured to a base receptacle of a preexisting floodlight enclosure (not shown) via a superseded light source mounting arrangement thereof and a corresponding mounting arrangement 322 (e.g., a series of mounting apertures, threaded holes, threaded studs, embedded nuts, etc.) of the retrofit bracket 300. When the retrofit bracket 300 is fixedly secured to the preexisting floodlight enclosure in this manner, the light generation assemblies may be supported by the light generation support platform 302 of the retrofit bracket 300 within the interior cavity of the floodlight enclosure opposite a cover thereof to emit light therefrom. In some instances, light generated by the solid-state elements of the light generation assemblies may generally or substantially replicate or resemble light previously generated by the superseded light source.

With continued reference to FIG. 6, the retrofit bracket 300 may include opposing sidewalls 330 that extend from a periphery of the light generation support platform 302. A respective driver mounting arrangement 340 may be provided on each of the opposing sidewalls 330. The opposing sidewalls 330 may taper inwardly with increasing distance away from the light generation support platform 302. One or more additional mounting elements, such as, for example, a threaded stud 341, may be provided on one or more of the opposing sidewalls 330 for grounding purposes.

The retrofit bracket 300 may further include opposing mounting flanges 320 that extend laterally beyond the light generation support platform 302. The mounting flanges 320 may include the mounting arrangement 322 that corresponds to the superseded light source mounting arrangement of the floodlight enclosure. The mounting flanges 320 may be parallel to and offset from the light generation support platform 302, as shown in the embodiment of FIG. 6, or may be an extension of the light generation support platform 302 with common opposing surfaces. In some instances, the mounting arrangement 322 may be arranged at a peripheral edge portion of the retrofit bracket 300 to mount to a corresponding periphery of the preexisting floodlight enclosure.

The opposing sidewalls 330 of the retrofit bracket 300 may define a channel beneath the light generation support platform 302 within which to receive one or more of the solid-state lighting element drivers. The opposing sidewalls 330, the mounting flanges 320 and the light generation support platform 302 may be portions of a single-piece of formed sheet material, such as, for example, a sheet of steel or aluminum material formed into the structure shown in FIG. 6 by appropriate bending operations.

The various mounting arrangements 310*a-c*, 322, 340 may be formed integrally into the sheet material (e.g., punched, stamped or cut) or otherwise coupled to the sheet material, as in the case of embedded studs or threaded inserts. Some of the mounting arrangements 322 may include elongated slots and/or multiple overlapping arrangements to enable mounting of the retrofit bracket 300 to more than a single preexisting floodlight enclosure. Accordingly, the retrofit bracket 300 may be used to retrofit a variety of preexisting floodlight systems 10 from one or more different manufacturers to include solid-state lighting functionality.

With reference to FIG. 7, yet another example embodiment of a retrofit bracket 400 is shown for alternatively supporting light generation assemblies of different sizes (not shown) within an internal cavity of a preexisting floodlight enclosure to selectively emit a flood of light therefrom. The light generation assemblies may be, for example, HTS Series 8, 9 and 12 LED lighting products available from Lighting Bare Development, Inc. of Countryside, Ill.

With reference to FIG. 7, the retrofit bracket 400 includes a light generation support platform 402 and a base structure 404. The light generation support platform 402 may be a planar portion of the retrofit bracket 400 that provides a platform or stage upon which to alternatively mount the light generation assemblies of different sizes, as represented by the phantom lines labeled 416*a*, 416*b*. According to the example embodiment of the retrofit bracket 400 shown in FIG. 7, the light generation support platform 402 comprises a pair of flanges 412 arranged at opposing lateral ends of the retrofit bracket 400. A space or gap 414 is provided between the flanges 412 that leave a substantial portion of the underside of the mounted light generation assembly exposed, which may assist in air circulation and cooling of the light generation assembly during operation. The flanges 412 of the support platform 402 may include overlapping light generation assembly mounting arrangements 410*a*, 410*b* (e.g., overlapping series of mounting apertures, threaded holes, threaded studs, embedded nuts, etc.) for alternatively coupling one of differently sized light generation assemblies to the support platform 402 of the retrofit bracket 400. As an example, the embodiment of the retrofit bracket 400 shown in FIG. 7 includes an outer series or grouping of apertures and an inner series or grouping of apertures, each arranged in a rectangular pattern, and wherein each aperture is sized to receive a corresponding threaded fastener to secure one of differently sized light generation assemblies to the support platform 402.

With continued reference to FIG. 7, the retrofit bracket 400 may include a driver mounting arrangement 440 (e.g., a series of mounting apertures, threaded holes, threaded studs, embedded nuts, etc.) located remote from the light generation support platform 402 for fixedly coupling a solid-state lighting element driver (not shown) to the retrofit bracket 400. As an example, the embodiment of the retrofit bracket 400 shown in FIG. 7 includes a pair of threaded studs and a series of apertures arranged in overlapping rectangular patterns for securing one of differently sized solid-state lighting element drivers to the retrofit bracket 400. As can be appreciated from FIG. 7, the solid-state lighting element driver may be fixedly coupled to the retrofit bracket 400 via the driver mounting arrangement 440 within a space between the light generation support platform 402 and a rear wall of the floodlight enclosure.

With continued reference to FIG. 7, the retrofit bracket 400 may be fixedly secured to the base receptacle of the preexisting floodlight enclosure (not shown) via a superseded light source mounting arrangement thereof and a corresponding mounting arrangement 422 (e.g., a series of mounting apertures, threaded holes, threaded studs, embedded nuts, etc.) of the retrofit bracket 400. As an example, the embodiment of the retrofit bracket 400 shown in FIG. 7 includes a mounting arrangement 422 comprising threaded nuts embedded in the retrofit bracket 400 to receive threaded fasteners through a rear wall of the floodlight enclosure. When the retrofit bracket 400 is fixedly secured to the preexisting floodlight enclosure in this manner, the light generation assembly may be supported by the light generation support platform 402 of the retrofit bracket 400 within the interior cavity of the floodlight enclosure opposite a cover thereof to emit light therefrom. In some instances, light generated by the solid-state elements of the light generation assembly may generally or substantially replicate or resemble light previously generated by the superseded light source.

With continued reference to FIG. 7, the base structure 404 of the retrofit bracket 400 may include a floor 420 and opposing sidewalls 430 that extend between the light generation support platform 402 and the floor 420. The floor 420 may be offset and parallel to the light generation support platform 402. The opposing sidewalls 430 may be perpendicular to the light generation support platform 402 and the floor 420, or may be inclined at an angle relative to the light generation support platform 402 or the floor 420 that is not perpendicular. One or more additional mounting elements, such as, for example, a threaded stud 441, may be provided on one or both of the opposing sidewalls 430 for grounding purposes. The opposing sidewalls 430 may be of sufficient length to create a pocket or cavity between the light generation support platform 402 and the floor 420 to house or receive the solid-state lighting element driver. The base structure 404, including the floor 420 and opposing sidewalls 430, and the light generation support platform 402 may be portions of a single-piece of formed sheet material, such as, for example, a sheet of steel or aluminum material formed into the structure shown in FIG. 7 by appropriate bending operations.

The various mounting arrangements 410*a*, 410*b*, 422, 440 may be formed integrally into the sheet material (e.g., punched, stamped or cut) or otherwise coupled to the sheet material, as in the case of embedded studs or threaded inserts. Some of the mounting arrangements 422 may include elongated slots and/or multiple overlapping arrangements to enable mounting of the retrofit bracket 400 to more than a single preexisting floodlight enclosure. Accordingly, the retrofit bracket 400 may be used to retrofit a variety of preexisting floodlight systems 10 from one or more different manufacturers to include solid-state lighting functionality.

Moreover, in some embodiments, the base structure 404 of the retrofit bracket 400 may include an extension 450, 452 having a mounting face 454 that is arranged perpendicular to the light generation support platform 402 to be secured to a sidewall 25 (FIG. 3) of the base receptacle 22 of the floodlight enclosure 20. For this purpose, the mounting face 454 may include at least one supplemental mounting arrangement 460, 462 for securing the extension 450, 452 and hence bracket 400 to the sidewall 25 of the base receptacle 22. When secured in this manner, the floor 420 of the retrofit bracket 400 may be supported in a position that is offset from the rear wall 23 (FIG. 3) of the base receptacle 22. In other instances, the floor 420 may be secured to the rear wall 23 of the base receptacle 22 while the extension 450, 452 is secured to the sidewall 25 by one of the supplemental mounting arrangements 460, 462 thereof. The supplemental mounting arrangements 460, 462 may be configured to correspond to one or more preexisting mounting arrangements 31 (FIG. 3) on the sidewall 25 of the base receptacle 22 of the floodlight enclosure 20, including, for example, a mounting arrangement 31 that may be used to secure the junction box 30 to the base receptacle 22.

It will be appreciated by those of ordinary skill in the relevant art that aspects and features of the various embodiments of the retrofit brackets 100, 200, 300, 400 described above can be combined to provide further embodiments, and that embodiments may be practiced without one or more of the specific details shown and described with reference to the embodiments of the retrofit brackets 100, 200, 300, 400 of FIGS. 4 through 7.

It will also be appreciated that related methods of retrofitting a floodlight system having a superseded light source, such as a metal halide or high pressure sodium light source, to a solid-state lighting system may be provided in connection with the retrofit systems and brackets described herein. For example, one method of retrofitting a floodlight system having a superseded light source and a floodlight enclosure to a solid-state lighting system may include removing the superseded light source from an interior of the floodlight enclosure and installing at least one solid-state light generation assembly and a corresponding solid-state lighting element driver within the interior of the floodlight enclosure using a retrofit bracket 100, 200, 300, 400 and a preexisting mounting arrangement of the floodlight enclosure. The retrofit bracket may support the at least one light generation assembly in a position to emit a flood of light from the retrofitted floodlight system and may concurrently support the solid-state lighting element driver outside a path of the flood of light. The method may further include attaching the at least one light generation assembly and corresponding solid-state lighting element driver to a power source through a preexisting conduit of the floodlight enclosure. For example, the light generation assembly and corresponding solid-state lighting element driver may be wired to a power source via a preexisting junction box of the floodlight enclosure. In other instances, a cable or wiring harness may be routed to the interior of the floodlight enclosure and connected to the light generation assembly 50 and corresponding solid-state lighting element driver 70 with conventional connectors, such as, for example, wire nuts and the like.

Moreover, aspects and features and the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A retrofit floodlight system, the system comprising:

a floodlight enclosure for protecting a light source from an external environment, the floodlight enclosure including a base receptacle and a cover coupled to the base receptacle to define an interior cavity, the base receptacle including a superseded light source mounting arrangement;

at least one light generation assembly including an array of solid-state lighting elements operable to collectively emit a flood of light from the floodlight enclosure;

a retrofit bracket including a light generation support platform and a base structure, which are portions of a single-piece of formed sheet material, the retrofit bracket fixedly secured to the base receptacle of the floodlight enclosure via the superseded light source mounting arrangement and the at least one light generation assembly supported by the light generation support platform of the retrofit bracket within the interior cavity of the floodlight enclosure opposite the cover; and a solid-state lighting element driver fixedly coupled to the retrofit bracket within the interior cavity of the floodlight enclosure, wherein the base structure of the retrofit bracket includes a floor that is offset and parallel to the light generation support platform and includes a second mounting arrangement provided on the floor, and wherein the solid-state lighting element driver is fixedly coupled to the retrofit bracket via the second mounting arrangement.

2. The retrofit floodlight system of claim 1 wherein the solid-state lighting element driver is fixedly coupled to the retrofit bracket in a space defined between the light generation support platform and a rear wall of the base receptacle of the floodlight enclosure.

3. The retrofit floodlight system of claim 1 wherein the base structure of the retrofit bracket includes opposing sidewalls that extend between the floor and the light generation support platform.

4. The retrofit floodlight system of claim 1 wherein the base structure of the retrofit bracket includes an extension having a mounting face that is arranged perpendicular to the light generation support platform and secured to a sidewall of the base receptacle of the floodlight enclosure.

5. The retrofit floodlight system of claim 4 wherein the mounting face includes at least one supplemental mounting arrangement, and the extension is secured to the sidewall of the base receptacle of the floodlight enclosure by the at least one supplemental mounting arrangement.

6. The retrofit floodlight system of claim 5 wherein the floor is supported in a position that is offset from a rear wall of the base receptacle of the floodlight enclosure.

7. The retrofit floodlight system of claim 1, further comprising a supplemental light generation assembly that is supported by the light generation support platform of the retrofit bracket adjacent the other light generation assembly.

8. A retrofit floodlight system, the system comprising:

a floodlight enclosure for protecting a light source from an external environment, the floodlight enclosure including a base receptacle and a cover coupled to the base receptacle to define an interior cavity, the base receptacle including a superseded light source mounting arrangement;

at least one light generation assembly including an array of solid-state lighting elements operable to collectively emit a flood of light from the floodlight enclosure;

a retrofit bracket including a light generation support platform and a base structure, which are portions of a single-piece of formed sheet material, the retrofit bracket fixedly secured to the base receptacle of the floodlight enclosure via the superseded light source mounting arrangement and the at least one light generation assembly supported by the light generation support platform of the retrofit bracket within the interior cavity of the floodlight enclosure opposite the cover; and a solid-state lighting element driver fixedly coupled to the retrofit bracket within the interior cavity of the floodlight enclosure, wherein the base structure of the retrofit bracket includes a second mounting arrangement located remote from the light generation support platform, and wherein the solid-state lighting element driver is fixedly coupled to the retrofit bracket via the second mounting arrangement, and wherein the light generation support platform includes a light generation assembly mounting arrangement and a supplemental light generation assembly mounting arrangement to accommodate a plurality of light generation assemblies.

9. The retrofit floodlight system of claim 8 wherein the light generation assembly mounting arrangement and the supplemental light generation mounting arrangement overlap to alternatively support light generation assemblies having different sizes.

10. A retrofit bracket for converting a floodlight system having a superseded light source and a floodlight enclosure to a solid-state lighting system, the retrofit bracket comprising:

a light generation support platform to accommodate and support at least one solid-state light assembly within an interior cavity of the floodlight enclosure, the light generation support platform including a first mounting arrangement for fixing the at least one solid-state lighting assembly to the retrofit bracket;

opposing sidewalls extending away from the light generation support platform; and a floor offset from the light generation support platform by the opposing sidewalls, the floor including a second mounting arrangement for fixing the retrofit bracket to the floodlight enclosure and a third mounting arrangement for fixing a solid-state lighting element driver to the retrofit bracket in a space between the floor and the light generation support platform.

11. The retrofit bracket of claim 10, further comprising:

an extension having a mounting face that is arranged perpendicular to the light generation support platform and that includes at least one supplemental mounting arrangement to secure the extension to a sidewall of an alternate floodlight system.

12. A retrofit bracket for converting a floodlight system having a superseded light source and a floodlight enclosure to a solid-state lighting system, the retrofit bracket comprising:

a light generation support platform to accommodate and support at least one solid-state light assembly within an interior cavity of the floodlight enclosure, the light generation support platform including a first mounting arrangement for fixing the at least one solid-state lighting assembly to the retrofit bracket;

opposing sidewalls extending away from the light generation support platform;

a floor offset from the light generation support platform by the opposing sidewalls, the floor including a second mounting for fixing a solid-state lighting element driver to the retrofit bracket in a space between the floor and the light generation support platform; and an extension having a mounting face that is arranged perpendicular to the light generation support platform and that includes a third mounting arrangement to secure the extension to a sidewall of the floodlight enclosure.

* * * * *